US005082284A

United States Patent [19]

Reed

[11] Patent Number: 5,082,284

[45] Date of Patent: Jan. 21, 1992

[54] GOLF SWING ANALYSIS DEVICE

[76] Inventor: J. Don Reed, 113 Cougar Ct., Grass Valley, Calif. 95949

[21] Appl. No.: 715,975

[22] Filed: Jun. 17, 1991

[51] Int. Cl.[5] ..... A63B 69/36

[52] U.S. Cl. ..... 273/186 E; 273/199 A; 273/DIG. 30; 273/58 K; 273/346

[58] Field of Search ..... 273/186 E, 186 A, 186 C, 273/186 D, 199 R, 199 A, DIG. 30, 58 K, 346, 194 R, 194 A, 194 B

[56] References Cited

U.S. PATENT DOCUMENTS 3,401,941 9/1968 Hesidence ..... 273/186 E
3,721,447 3/1973 Louderback ..... 273/186 E
3,870,316 3/1975 DeBrocke ..... 273/186 E

*Primary Examiner*—George J. Marlo

*Attorney, Agent, or Firm*—Mark C. Jacobs

[57] ABSTRACT

A device to improve one's golf swing made of hook and loop engageable material. The hook material is fabricated into a club face cover preferably highlighting the sweet spot on the golf club. The design is fabricated from many separate pieces held together with double back adhesive tape filament holding the design together on one side and adhering to the wood or iron club face on the other side. The loop material is wrapped around a low mass soft sponge ball and is attached to a foot commonly known as a tee forming the target. When the club face cover hits the target, the nature of the hook and loop material causes the target to engage the club face's loops thus marking the spot the target engaged the club and showing the manner in which the target was hit as the target temporarily changes its shape.

17 Claims, 5 Drawing Sheets

GOLF SWING ANALYSIS DEVICE

FIELD OF THE INVENTION

Background of the Invention

This invention relates to a golf stroke practice aid; and, more particularly, to a device for indicating to a golfer where on the face of a golf club, impact was made when the club contacted a golf ball during a swing of the club.

DESCRIPTION OF THE PRIOR ART

It is desirable as in any game for one to practice the game of golf in order to improve the quality of ones game. Oftentimes however, people do not have ready access to golf courses or driving ranges such that they can study their stroke and practice hitting the ball. It is necessary therefore for them to find a mode of practicing and analyzing their swing in a restricted area such as an open section within their residence or in their back yard or other relatively confined space.

One answer has been to use a golf ball formed like a whiffle ball, which is of the same shape and size of a golf ball, but which is made of polyethylene often with apertures through the circumference of the ball. Such plastic balls, however, when driven indoors can cause damage to furniture and other objects, as well as inflict injury to the person.

A common replacement for such plastic-type golf balls has been the use of Velcro ®-covered pads to engage Velcro ®-covered balls or other objects to simulate the impact of golf club upon a golf ball. Indeed, several patents have been issued on such subject matter. Velcro ®material includes two components or portions, a male or hook portion and a female or a loop portion which two portions can be releaseably hookingly engaged to each other.

We are familiar with following U.S. Pat. Nos.; Hesidence, 3,401,941, issued Sept. 17, 1968; Laterbock, 3,721,447, issued Mar. 20, 1973; Brandell, 3,806,132, issued Apr. 23, 1974; DeBrocke, 3,870,316, issued Mar. 11, 1975; and Brown, 4,826,173, issued May 2, 1989. Each of these patents has its own deficiency and therefore has not succeeded in the marketplace to the best of knowledge of the applicant. For example, the DeBrocke reference does not provide for the use of a covering on the entire face of the golf club. Reference is made, for example, to Debrocke s FIG. 7. This can create a problem to beginners, because oftentimes they will impact the ball, with a corner or section of the club—be it iron or wood —not covered by the pad shown in the DeBrocke reference.

The Brandell reference uses a ball with a slight marker on it as per Brandell's FIG. 3 and the entire face of the golf club shown in Brandell's FIG. 4 is also not marked as is suggested.

The Hesidence patent distorts the configuration of a golf club head, by placing a weight of material on the head. Said added material being designated 10 in the Hesidence patent.

In the Laterbock patent the ball separates from the tee. The structure can cause confusion to the user, in his attempt to visually compare the tee to a standard tee. The type of support mechanism used by this reference somewhat resembles a mushroom stem.

The "ball" of the Brown's device is merely an annular member, as opposed to being spherical and actually resembling a ball. Again this can create confusion for the user.

It is therefore an object of this invention to provide a golf practice device which will enable the user to determine the point of impact of the golf club with a simulated golf ball to thereby analyze the golf swing.

Another object is to provide a Velcro ®-covered golf club head and a Velcro ®-covered-tee-mounted simulated golf ball which can engage each other, with the male or hook portion being on the club and the female or loop portion being on the ball.

It is yet another object to provide a specific design for the face cover which is to be applied to the club face.

A further object is to provide a club face cover in various colors to help locate the "sweet spot" of the style of club being used be it wood or iron.

A yet further object is to provide a multicolored club face cover for attachment to a club face.

A still further object is to provide a means of producing a multicolored Velcro ® club face cover for attachment to a club face.

An additional object is to provide a device of the type described which when utilized will permit the golfer to extensively practice his or her swing, determine where the particular club is impacting the golf ball and carry out this practice in a very confined area.

This and other objects of the invention will in part be obvious and will in part appear hereinafter. The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

FIG. Il is a perspective view of the club face pad for a golf wood; and

Figure 12:
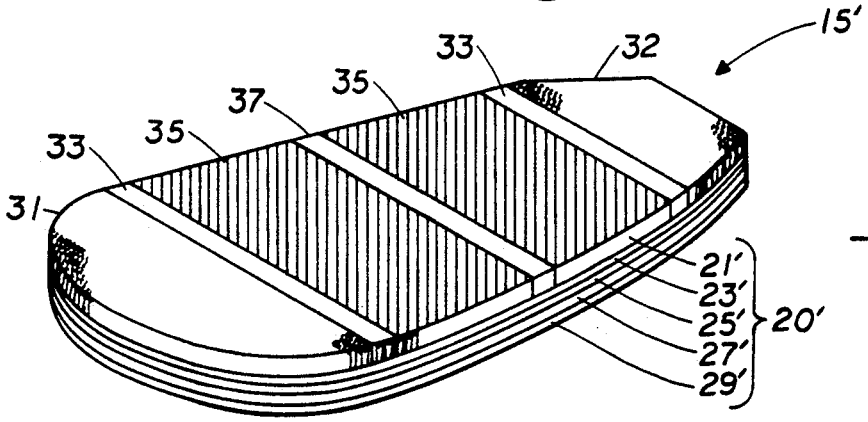

FIG. 12 is a perspective view of the club face pad for a club iron.

Figure 13:
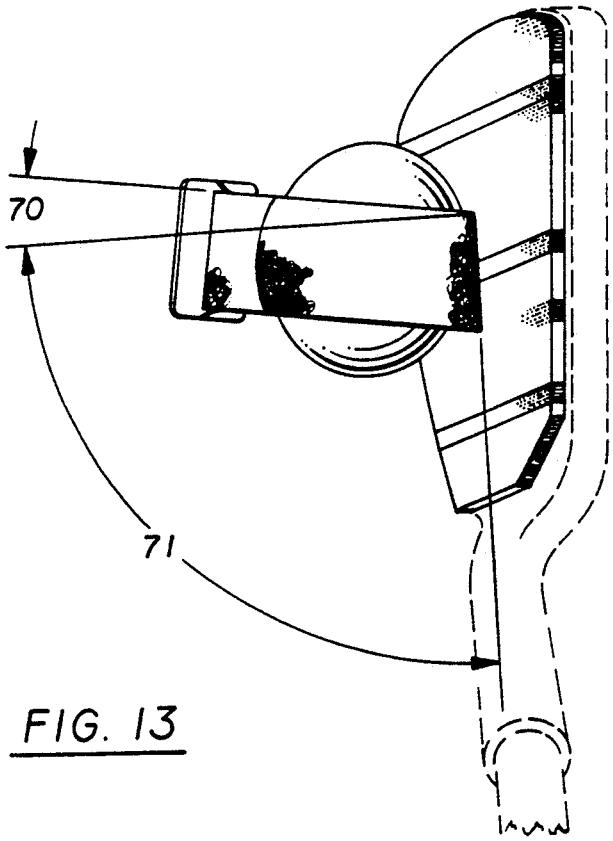

FIG. 13 is a top view of the "ball" of this invention after impaction on an iron face the disposition of which indicates a hooking action upon the ball at the time of club contact.

SUMMARY OF THE INVENTION

The invention comprises a pad to be secured to the club face of a golf club wood or iron. The material employed for the club face pad or cover is the hook or male portion of a Velcro ®closure. A simulated golf ball is formed of a foam material around which is wrapped in one plane a strip of loop or female Velcro ®. This Velcro ® continues downwardly and outwardly away from said ball to cover over an inverted T-shape thermoplastic rubber member to thereby form a golf tee with a simulated ball thereupon. This ball-tee combination is designated a pseudo ball.

DESCRIPTION OF THE PREFERRED EMBODIMENT

Figure 1:
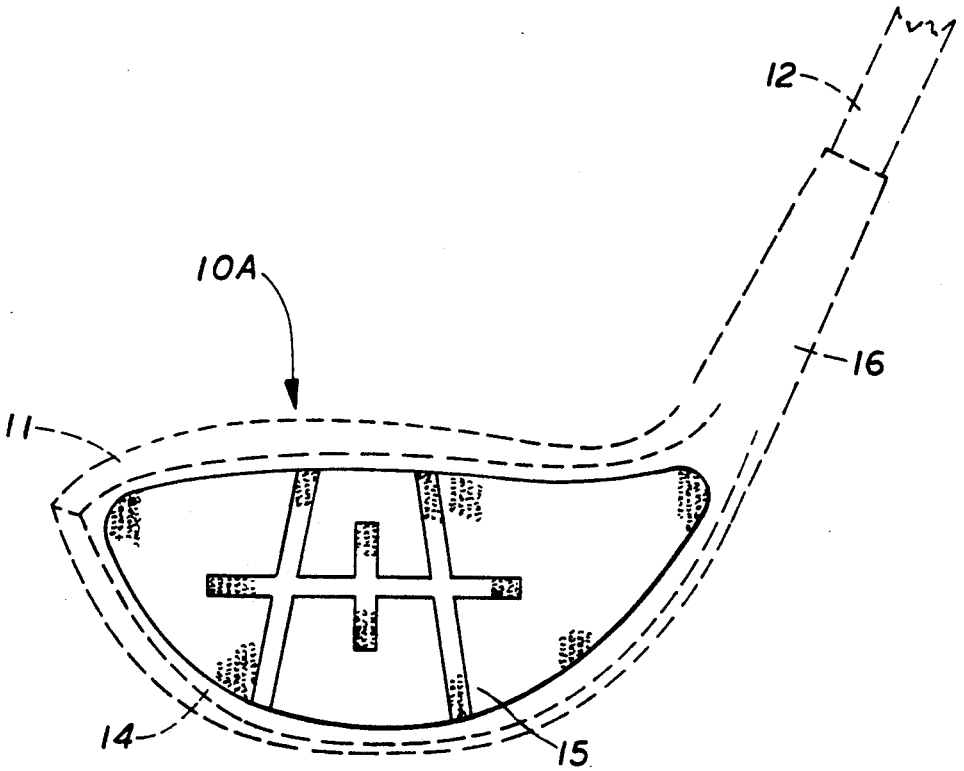
FIG 1 is a front elevational view of the head of a golf club wood with one part of the invention secured to the face of the club head.
Figure 2:
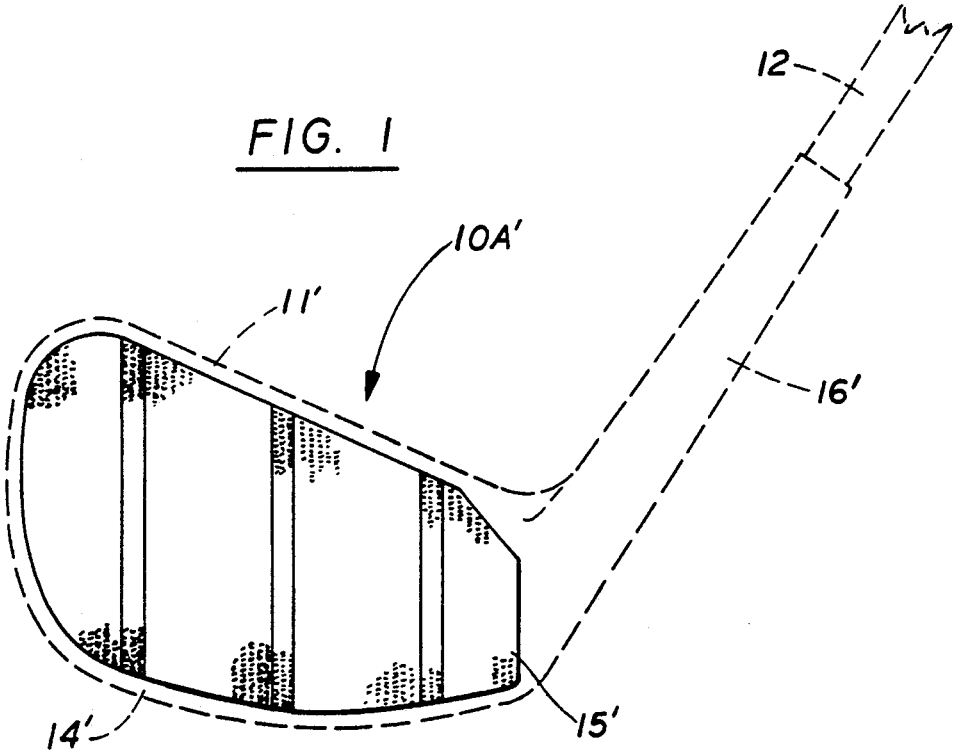
FIG. 2 is a view similar to FIG. 1 but of a golf club iron.
Figure 3:
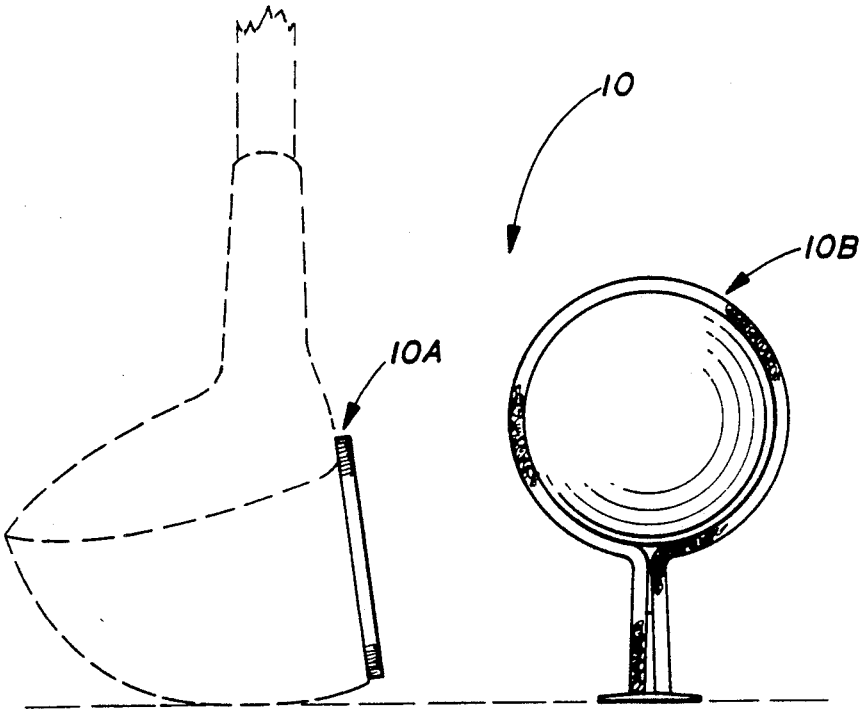
FIG. 3 is a side elevational view of a golf club wood about to impact a teed up simulated golf ball of this invention.
Figure 4:
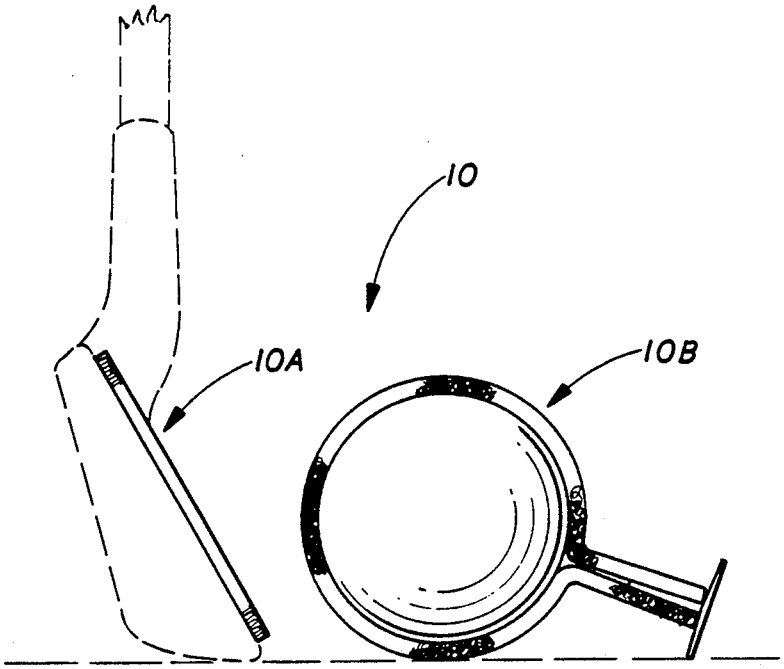
FIG. 4 is a side elevation view of a golf club iron approaching the simulated ball of this invention while the ball is lying on the ground.

This invention comprises two parts, (1) a modified golf club, and in particular the club face, and (2) a pseudo ball. In FIG. 1 the general designator 10A is utilized because the invention comprises two parts; namely, a modified golf club 10A and a pseudo golf ball 10B shown in FIG. 3. In FIG. 2 there is shown a variant of the instant invention; namely a golf iron 10A'.

Turning now to FIG. 1 wherein a golf club 10A being a wood 10 club is shown. This club has a head 11 connected to a shaft 12 via a hosel (connector) 16 which hosel is integrally formed with the head 11 as is known in the art. Club 10A includes a flat striking face 14 upon which is adhesively secured a face cover 15. This face cover is comprised of a plurality of sections as is seen by reference to FIG. 8. Cover 15 included a left side 17, a right side 19, a top section 18, a bottom section 22, and an intermediate section 24, all of which go together in jigsaw puzzle fashion to interlock. The mode of assembly of face cover 15 will be discussed below.

In FIG. 2 there is seen a golf iron which comprises a club head 11' having a face 14 connected via the hosel 16" to shaft 12". The face cover shown on the club face 14" is designated 15", because it is of a different configuration than that utilized for a wood club which cover bears the number 15. The face cover 15 and the face cover 15', both comprise laminates 20 of the four layers shown in FIG. 10. The first layer 21 is the hook portion of the hook-and-loop closure material sold under the trademark Velcro ®. Other manufacturers sell similar hook-and-loop-type products. Laminate 20 is seen to comprise a hook layer 21 adhesed on its underside to a woven filament tape layer 25 by adhesive 23. A second adhesive layer 27 of a tack that would optionally allow it to be pealed off of the club face and reapplied many times is coated or otherwise disposed upon the underside of the nylon or other plastic filament tape. A peelable safety layer 29 to prevent inadvertent adhesion of layer 27 is removably secured to layer 27. The use of such peelable adhesion preventive layers is well known in the art, such as in peel and stick labels.

Figure 10:
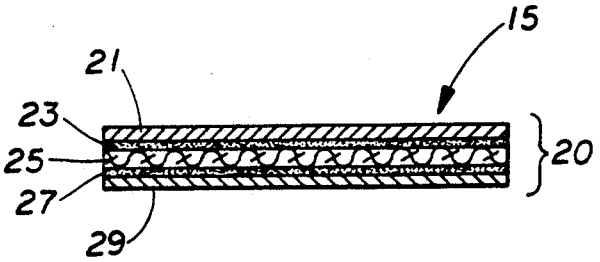
FIG. 10 is a sectional view illustrating lamination.

While FIG. 10 shows the structure of the face cover 15 in sectional view, FIG. shows the structure in a more perspective view. Note how the peelable layer 29 is shown partially removed from the underside adhesive 27 such that when 29 is fully peeled away the laminate 20 is ready for disposition upon club face 14 as per FIG. 1. Since the laminate structure of the face cover of FIG. 2 is identical to the face cover of FIG. 1, except for the physical configuration of the various shapes comprising the hook layer, there is no need to repeat the sectional view shown in FIG. 10. In FIG. 12, however, the laminate 20" includes layers 21", 23", 25", 27" and 29". Layers 23" through 29" are structurally the same but configured slightly different for the iron club than for the wood club. Layer 21" is seen as a different configuration than the wood-type face cover because the "sweet spot" on an iron or putter is different from that on a wood club. This laminate includes a pair of dissimilar end sections 31, 32 each emanating at the one outer end and moving inwardly along the face of the club, a first set of divider sections 33, a pair of inner sections 35 and a center section disposed between each of the inner sections, said center section being designated 37.

Figure 5:
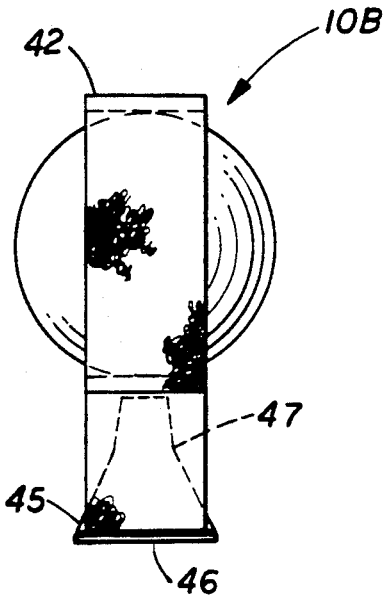
FIG. 5 is a front elevational view of the "ball" of this invention.
Figure 6:
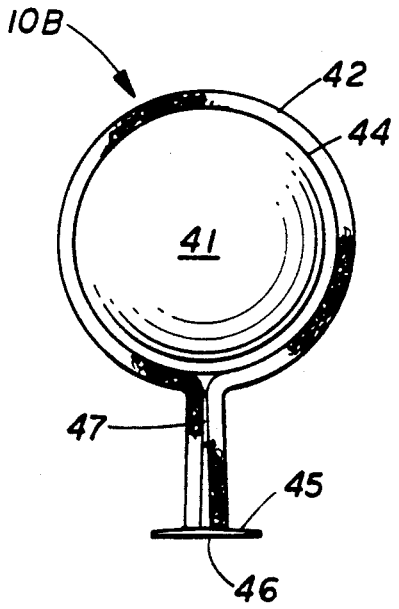
FIG. 6 is a side elevational view of the "ball" of FIG. 5.

Discussion now moves to FIGS. 3, 4, 5 and 6 concerning element 10B the pseudo ball of this invention. The pseudo ball 10B best seen inn FIGS. 3 and 4 comprises a low mass foam ball approximately 1⅝th inches inn diameter. Spherical foam ball 41 is overlaid with a covering 42 approximately ¾ inch in width as seen best in FIG. 4. Covering 42 comprises a strip or band of loop section of Velcro ®-brand or equal closure material having an adhesive layer 44 therebeneath. Covering 42 is overlaid in a strip substantially completely around the center of the ball along its great circle and then depends downwardly on the underside of the ball to overlay tee 45. Tee 45 comprises a T-shaped element having a base 46 and an upstanding member 47. The width of the base and the upstanding member are preferably equal to or slightly larger than the width of the covering 42. Covering 42 is overlaid preferably along the entire upstanding member 47 over the ball 41 and terminates on the far side of the upstanding member 47 at the junction of the upstanding member 47 with base 46. The thickness of the base and upstanding member are approximately 1/16th inch thick tapering narrower toward the edges. See also FIG. 4. Tee 45 may be made of a high impact plastic such as polypropylene, or of a thermoplastic rubber material capable of withstanding impact of the golf club head. A suggested shore durometer range for such rubbers is between 65 and 110 on the "A" scale. Pseudo ball 10B as used in this invention has the advantage that it can be placed such that the ball portion is in the air as for a tee-off shot as per FIG. 3 where a wood club is about to impact the ball as well as being able to be laid on its side as if to simulate positioning of a ball on the ground or on grass, ready to be impacted by a golf iron such as club 10A" as shown in FIG. 6.

Figure 7:
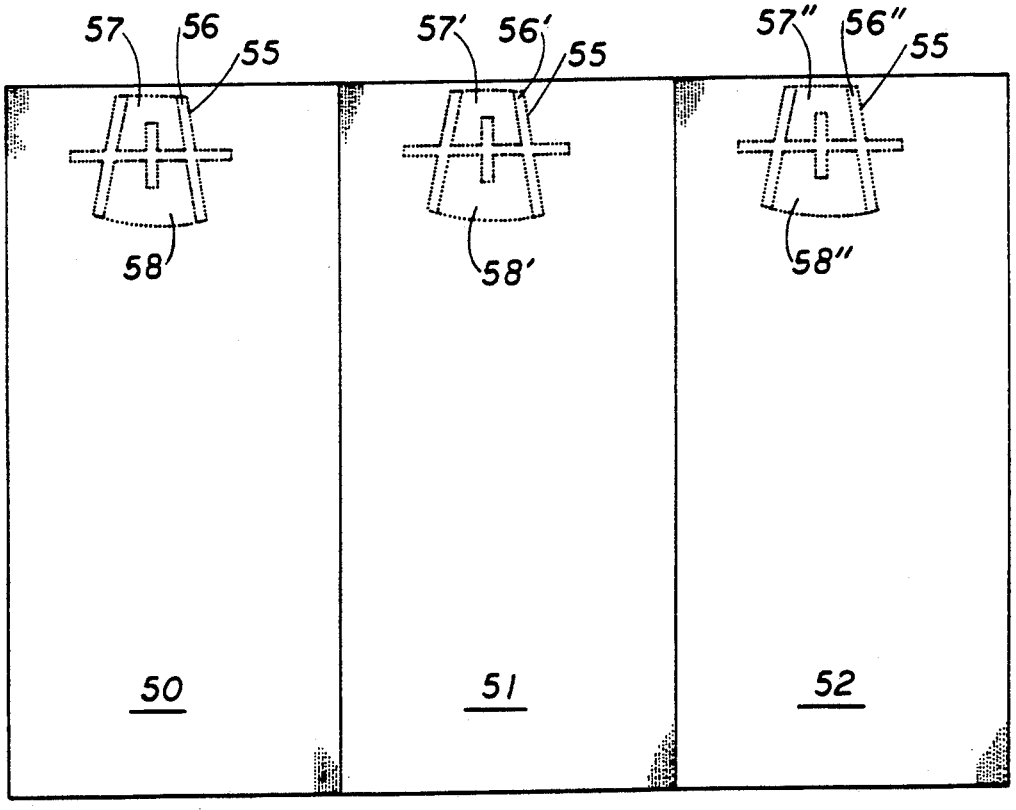
FIG. 7 is a diagrammatic elevational view illustrating one step in the manufacture of the club face pads of this invention.
Figure 8:
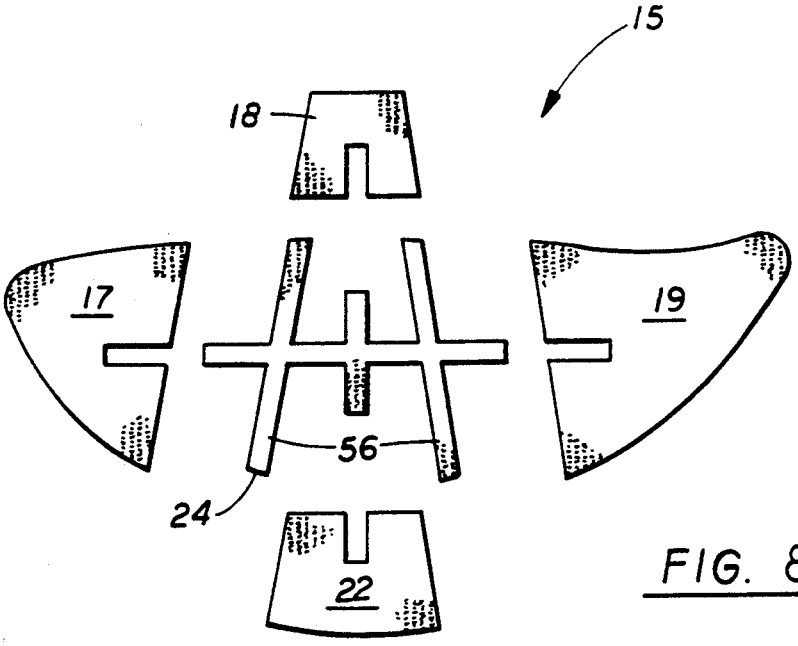
FIG. 8 is an exploded view of the sections Velcro ® that are used to create the club face pad shown in FIG. 7.
Figure 9:
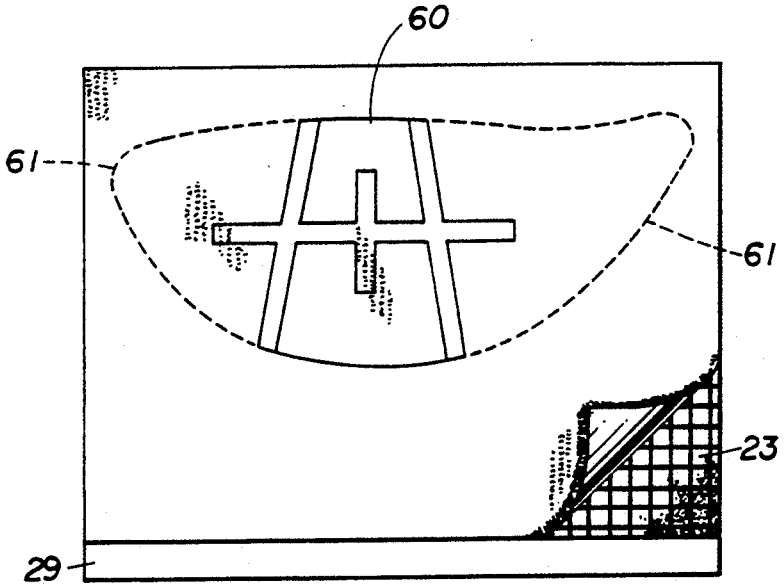
FIG. 9 is a diagrammatic view illustrating the manufacture of the club face pad of FIG. 7.

The discussion now turns to FIGS. 7, 8 and 9, which pertain to the assembly of the various sections of the cover face 15 for the wood club. The cover face 15" for the iron is done in identical fashion and need not be discussed separately.

Figure 11:
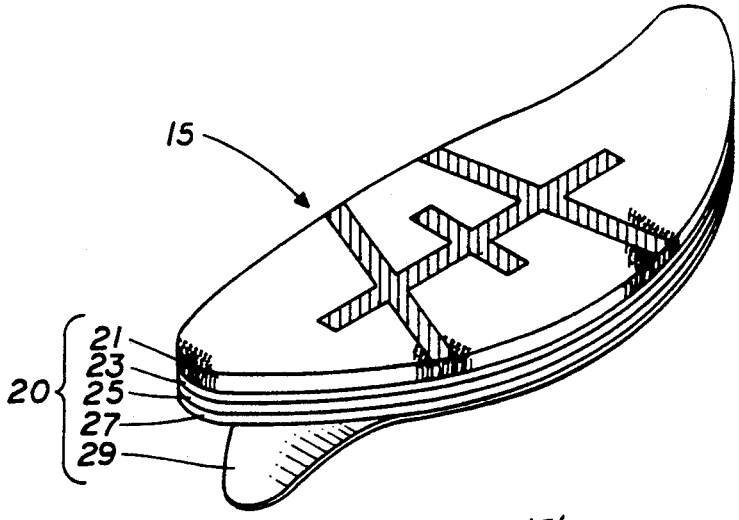

Three tandem tape lengths held in place by suitable jig mechanisms as are known in the art are moved incrementally through a three-head punch press. Such punch presses are well-known in the art and need not be illustrated here. Tape lengths 50, 51 and 52 are each different colors of unbacked, i.e., no adhesive hook Velcro ® sections. The face cover for the wood club is preferably but not necessarily of a plurality of colors, here three being the chosen number. Reference is made now to FIG. 11 where it is seen that the face cover is lined for a plurality of colors. That is, the two outer sections are lined for black the H-shaped section with the extra vertical piece is lined for red and the interior sections are lined for white. These colors can vary in that the outer sections could be red or white or any other color as could the other portions of the design. Therefore in order to produce such a colored result tape length 50 would be one color; namely, black, 51 a second color; namely, white, and 52 the third color; namely red. As these three tape lengths move simultaneously through the punch press incremental, a first dye cut is made corresponding to the dotted line 55 shown in each of the three colors. The first dye cut severs the H-shaped portion 24. The cutting element is similar to a cookie cutter in that it is configured to make the shape as may be desired.

The tape sections are retained in position after the cut has been made, along the work table such that the area cutout by cut 55 can be removed. Thus, three segments 56, 57 and 58, 56'', 57'', 58'' and 56'', 57'' and 58'' all of which have been cut by the first pass of the punch press are removed from the tape lengths 50, 51 and 52.

Each of the three strips is then inverted upon a tacky surface which will hold the hook fabric in a relatively stable position. The dye cut portions of any two other colors designated by (') and ('') are inserted into the cutout area of the third tape length such as tape length 50. Thus,: the white cutout section which would correspondingly be 57' and 58' would be inserted into the same location in the inverted black tape length 50. The H-shaped section 56'' from the red tape length 52 would also be manually inserted in place within the cutout 55 of the black tape length 50. Similarly other tri-color units can be pieced together in jigsaw puzzle fashion on the rear side of the white tape length 51 and the red tape length 52. Obviously, the patterns would be the same but the colors would be of a coordinating nature. Thus, the outer sections in the assembly of tape length 52 would be red rather than black as in tape length 50.

The next step is to place double side adhesive filament tape 25 such as nylon filament tape over the assemblage 60 per FIG. 9. FIG. 9 is truly not indicative of the steps involved, because it shows the assemblage face up whereas in fact it should be face down and because only one adhesive layer is seen of the two see FIG. 10, however, which does show both adhesive layers. A gentle rolling pressure is applied to the tape which comprises adhesive 23, filament layer 25, and adhesive 27 with a peelable layer 29 thereupon. Reference is again made to FIG. 9 wherein the peelable layer is shown extending beyond the taped layer for ease of illustration. Once the assemblage has been formed and adhesed into place on the filament tape, a second cut of the punch press is made along the periphery 61 of the entire assemblage through the taped and peelable layer. This second cut of the punch press is shown as dashed line 61 in FIG. 9. For purpose of recollection, reference is again quickly made to FIG. 8 which shows the various portions that form the assemblage 60 of FIG. 9.

It is to be understood that there is no criticality in color selection for the various sections and segments of the face cover just described.

When the club face cover is brought into contact with the pseudo ball such as in FIGS. 5 or 6 the covering 42 which comprises the loop section of Velcro ® on the-ball 41 hookingly engages the hook section of Velcro ® of the club face cover. Since the design of the two different club face covers is intended to pinpoint the "sweet spot" of the two different types of clubs, the nature of the swing can be determined from noting the location of the hooking engagement of the loop and hook sections of Velcro ®. Applicants pseudo ball 10B is the only ball unit known to applicant that can be used in dual fashion both as a tee mounted ball for tee off shots as well as a standard disposed ball such as lying in grass or in dirt for use with the irons. See FIGS. 5 and 6 respectively.

The device of this invention is also useful in training the player to maintain his head in the correct position since upon impact the ball does not fly and the player cannot necessarily visually track the ball. Rather the ball will be hookingly engaged to the club face cover. The hook and loop components or sections of Velcro ® co-act together to detachably secure the pseudo ball 10B to the club head cover 15 or 55 so that the exact positioning of one to the other can be readily ascertained. If one is "hooking" the pseudo ball will be removably secured at one location on the cover face and if one is "slicing" it will be engaged to another area on the club face cover.

It is seen that in view of the fact that the inherent coarse texture of hook and loop material formed into the golf device does not lend itself to be readily painted or silkscreened with a crisp clean line and the manufacturing technique of said material limits weaving a color change, the only way that the sweet spot on the club face can be highlighted is by utilizing an assembly technique of the nature disclosed herein. By providing for various colored sections no color of which is critical, one can readily try to line up the ball to the particular color area and then after the swing determine the capability of achieving the desired result.

One further advantage of this invention over similar prior art devices is the fact that by using a low mass rubber ball, beneath the covering, upon impact of the target 10B with the club face cover 10A, the ball will temporarily change shape in it's relationship to the red strip on the target, thus helping to give the golfer a further indication of the angle of incidence of the club to the ball. Upon removal of the target from the club face the soft ball will resume its original configuration. Suitable material for the low mass ball would be a density of 1.6 pound per cubic foot open cell polyurethane.

In designing the face covers of this invention I have 12 considered the purpose of each of the wood and iron clubs and what they are designed to achieve. The driver or wood club face is slightly convex, and is designed to impact the ball to 15 achieve maximum velocity and distance, as well as achieve maximal directional accuracy of the impacted ball's flight. These desires are achieved by a good golfer by hitting the ball at the correct angle of incidence on the "sweet spot". While this spot can change slightly from wood design to wood design, it will however remain somewhat constant as an area slightly larger at the bottom and narrower at the top of the club face, in the approximate middle thereof.

In my configuration for the wood club's face cover, I tried to point out to the golfer the location of the sweet spot. Thus, the horizontal center line should preferably be about 1.67'' long which is the diameter of a regulation golf ball. The vertical intersecting line marks the center of the sweet spot.

The width of the band of "loop" (female) Velcro ® material of the pseudo ball is sized to be preferably equal to the space between the two legs 56 of the H-shaped section of the club face cover. This relationship aids the golfer to achieve desired impact locations on the pseudo ball.

The face cover for the iron was similarly designed. As is known, the iron's club face is designed with a flat face to primarily achieve accuracy of distance and direction upon correct impact. In the configuration employed in my face cover, the central generally vertical line as shown here—not critical, points out the sweet spot center. Each large vertical stripe on the opposite sides thereof is equal the width of the band of loop Velcro® in the pseudo ball. The horizontal extension of the two black (not critical) vertical sections and the central vertical line are also equal to 1.67", the same as the diameter of a regulation golf ball. Thus after impact of the pseudo ball by an iron club face cover of this configuration the golfer can readily discern the location of the impact relative to the "sweet spot".

While the geometric configurations chosen for the face covers for the wood and iron club help the golfer find the "sweet spot" for the best shot with that club, other geometric configurations designed to achieve similar results are within the skill of the art.

As mentioned earlier, the combination of the configurations of the hook and loop material of the club face cover and the band on the pseudo ball help the player attempt to hit the pseudo ball at or near the "sweet spot" of the club face. In addition, one can determine whether the impact to the pseudo ball was at a correct 90 degree or whether the impact was at an angle that deviates from the 90 degrees.

When the pseudo ball which starts out in a static condition is angularly impacted, i.e., what is termed a "hook" in golfing parlance, that area of the club face cover which impacts the loop material of the band around the pseudo ball begins to immediately engage the loop material prior to the follow through of the club swing and the completion of the impact, i.e. a moment in time prior to the commencement of the travel of the pseudo ball from its at rest position of nonengagement. During the follow through upon impact, the pseudo ball becomes distorted, and is retained in its slightly distorted condition in an angular relationship with the club face cover. This enables the golfer to actually see the results of a hooking swing. The pseudo ball is retained in this distorted condition upon the club face cover until physically removed.

See FIG. 13 which illustrates the hooking angle incidence 70 of the pseudo ball compared to the normal 90° incidence, 71. The foam of the ball provides some friction to assist in this retention procedure.

It is also to be seen that the club face covers can be applied to the club face of either an iron or a wood club on a permanent basis, removably. If the latter the same face cover can be moved from club to club as desired. The ability to do this is dependent upon the nature of the adhesive employed. It is within the skill of the art to make this type of selection.

Thus it is seen that my invention differs from others in the prior art, because I permit the golfer to analyze his/her impact of the ball by using a mimic of the "sweet spot" of the particular club in connection with a pseudo ball correctly proportioned to that "sweet spot" (i.e., the sized loop Velcro® of the ball.)

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In combination, (I) a golf club having a club face said club face having a face cover adhered thereto over substantially the entire club face, said face cover having a front side and a rear side, the front side of which is the hook portion of a contact engageable material, the rear side being adhered to said club face, and, (II) a pseudo golf ball comprising a low mass foam ball having a strip of the loop portion of a contact engageable material, which material is overlaid over the top and vertically downward around the ball along its great circle, each end of said strip extending outwardly away from said ball, and an inverted T-shaped member having its upstanding portion interposed between said outwardly extending ends of said strip, and adhered thereto, whereby upon impact of the golf club with the face cover thereon with the strip of the pseudo golf ball said pseudo ball will become releasingly hookingly engaged to said club's face cover, to retain said ball in position on said face cover.

2. In the combination of claim I, wherein the strip of loop contact engageable material and the club face cover each have a layer of self-adhesive thereon on the side opposite the hookingly engageable side.

3. In the combination of claim 1 wherein the cover face contains indicia to display the location of the "sweet spot" of the club face.

4. In the combination of claim 3 wherein the sweet spot display comprises a trio of spaced generally bars, the distance between the inner edges of the first and third of which is equal to about the diameter of a golf ball, said display being intended for golf iron clubs.

5. In the combination of claim 3 wherein the sweet spot display comprises a generally H-shaped member having a vertical bar through the cross member of said H-shaped member, said display being intended for golf wood clubs.

6. In the combination of claim 3 wherein the indicia demonstrating the sweet spot on the club face is colored different from the rest of the club face cover.

7. In the combination of claim 1 wherein the strip of hookingly engageable material on the pseudo ball is about 0.75" in width.

8. A golf swing indicator device to illustrate to the golfer how his/her club is impacting the ball which swing indicator comprises:

a club face cover comprising the hook portion of a contact engageable hook and loop material, said hook portion having a layer of self-adhesive on the side opposite the hookingly engageable side, and sized to overlay substantially all of a golf club's face, and a pseudo golf ball comprising a low mass foam sphere having a band of loop portion of contact engageable material circumscribing the great circle of the sphere, each end of which band extends outward from said sphere to over lie a tee, and an inverted T-shaped member having a base and an upstanding member the upstanding member being interposed between the outward extending ends of said band. said cover being removedly hookingly engageable to said pseudo golf ball.

9. In the indicator of claim 8 wherein the tee is made of rigid plastic or thermoplastic rubber.

10. In the indicator of claim 8 wherein the sphere is polyurethane.

11. In the indicator of claim 8 wherein the club face cover bears indicia to point out the location of the sweet spot of the golf club face to which the cover is to be adhered.

12. A pseudo golf ball intended to be impacted by a golf club face having the hook portion of a contact engageable hook and loop material thereon, which pseudo ball comprises:

a low mass foam sphere having a band of the loop portion of hook and loop contact engageable material, adhered thereto, said band extending around a vertical great circle of said sphere, with each end of the band extending away from said sphere; and an inverted T-shaped unit having a base and an upstanding member, wherein the upstanding member is interposed and adhered between said ends of said band extending away from said sphere, whereby said pseudo ball can be placed in a position to simulate a golf ball disposed on a tee and said ball can also be placed on the ground for impact by a golf club in either of the two dispositions.

13. In the pseudo golf ball of claim 12 wherein the inverted T-shaped unit is made of rigid plastic or thermoplastic rubber.

14. In the pseudo golf ball of claim 12 wherein the band is about 3/4 inch in width.

15. In the pseudo golf ball of claim 12 wherein the width of the T-shaped member is substantially the same as the width of the band.

16. In the pseudo golf ball of claim 12 wherein the sphere is made of polyurethane foam.

17. In the pseudo golf ball of claim 16 wherein the foam has a density of about 1.6 pounds per cubic foot.

* * * * *